US012768223B2

(12) United States Patent
Pipare et al.

(10) Patent No.: US 12,768,223 B2
(45) Date of Patent: Oct. 20, 2026

(54) HATCH SYSTEM FOR DRILLING MACHINE

(71) Applicant: Caterpillar Global Mining Equipment LLC., Denison, TX (US)

(72) Inventors: Jaydeep Sunil Pipare, Pune (IN); Scott Alan Christianson, Edelstein, IL (US); Roberto Garcia, Sherman, TX (US); Charles Taylor Hudson, Sherman, TX (US)

(73) Assignee: Caterpillar Global Mining Equipment LLC., Denison, TX (US)

( * ) Notice: Subject to any disclaimer, the term of this patent is extended or adjusted under 35 U.S.C. 154(b) by 0 days.

(21) Appl. No.: 19/012,992

(22) Filed: Jan. 8, 2025

(65) Prior Publication Data

US 2026/0193939 A1 Jul. 9, 2026

(51) Int. Cl.
*E21B 7/02* (2006.01)
*E21B 15/00* (2006.01)

(52) U.S. Cl.
CPC ..... *E21B 7/026* (2013.01); *E21B 15/00* (2013.01)

(58) Field of Classification Search
CPC ..... E21B 7/026; E21B 15/00
USPC ..... 173/1–2, 13, 18–20, 184, 25–31, 38–39, 173/45–53
See application file for complete search history.

(56) References Cited

U.S. PATENT DOCUMENTS 541,835 A * 7/1895 Chapman ..... E21B 7/02 74/125.5
3,046,613 A * 7/1962 Smith ..... E06B 9/02 52/107
3,756,330 A 9/1973 Russell, Jr.
4,305,373 A * 12/1981 Martenson ..... F24B 1/1886 126/506
4,695,087 A * 9/1987 Hollrock ..... B62D 33/02 296/26.02
4,776,429 A * 10/1988 Osborn ..... B65G 69/22 182/147
5,073,080 A * 12/1991 Blum ..... E02F 3/962 414/23
5,389,059 A * 2/1995 Corwin ..... B65H 45/04 428/116
5,397,208 A * 3/1995 Siebenga ..... A01D 87/127 414/556

(Continued)

FOREIGN PATENT DOCUMENTS

CA 2708520 A1 * 7/2009 ..... E21B 7/005
CA 2912752 C * 5/2018 ..... E21B 7/026

(Continued)

*Primary Examiner* — Robert F Long

(57) ABSTRACT

A hatch system includes a viewing grate removably coupled with a deck of the drilling machine. The viewing grate includes a frame and a number of bars extending along an oblique direction relative to the frame. The number of bars is spaced apart from each other. The hatch system also includes a hatch assembly disposed at a first oblique angle relative to the deck of the drilling machine. The hatch assembly includes a body and a door that is movable between an open position and a closed position relative to the body. In the open position of the door, an operator seated within an operator cabin can view a drill bit of the drilling machine via the viewing grate. In the closed position of the door, the door isolates the deck from the dust chamber and the door is in line with the viewing grate.

18 Claims, 7 Drawing Sheets

(56) References Cited

U.S. PATENT DOCUMENTS 5,752,348 A * 5/1998 Pearson ..... E04F 17/06 52/107
5,941,024 A * 8/1999 Journault ..... E02D 29/1463 182/112
5,954,143 A * 9/1999 McCabe ..... E21B 7/025 173/171
6,095,263 A 8/2000 Saunders et al.
6,431,093 B1 * 8/2002 Hansen ..... B60R 3/005 182/84
6,520,592 B1 * 2/2003 Bobholz ..... E01C 23/121 173/100
7,503,339 B1 * 3/2009 Bogan ..... E03F 5/22 137/364
8,250,815 B2 * 8/2012 Siepel ..... E04F 17/06 52/107
8,646,223 B2 * 2/2014 Brewka ..... E04G 13/06 52/107
8,801,041 B2 * 8/2014 Barrett ..... B60R 3/005 182/20
9,057,221 B2 6/2015 Warr
9,157,812 B1 * 10/2015 Gennello ..... G01K 13/00
9,416,514 B2 * 8/2016 Niekamp ..... E02D 7/08
9,777,459 B2 * 10/2017 Zuritis ..... E02F 3/3414
9,976,280 B2 * 5/2018 Honermann ..... E02F 3/962
10,309,094 B2 * 6/2019 Avelin ..... E04B 1/003
10,780,831 B2 * 9/2020 Oliver ..... B60R 3/005
10,844,664 B2 * 11/2020 Nelson ..... E21D 21/008
2002/0152731 A1 * 10/2002 Reich ..... B23Q 11/0046 55/385.1
2003/0037489 A1 * 2/2003 McKernan ..... E02D 29/127 49/63
2005/0244227 A1 * 11/2005 Akkala ..... E02D 29/14 404/25
2006/0120848 A1 * 6/2006 Guhr ..... E02F 3/96 414/723
2006/0162963 A1 * 7/2006 Hagemeyer ..... E21B 19/146 175/85
2007/0193749 A1 * 8/2007 Folk ..... E21B 7/02 166/380
2009/0020349 A1 * 1/2009 Renard ..... B62D 25/10 180/69.2
2011/0049932 A1 * 3/2011 Hobenshield ..... B62D 33/0617 296/190.1
2011/0061161 A1 * 3/2011 Erlebach ..... E03F 5/0408 4/679
2012/0009862 A1 * 1/2012 Meyer ..... H05K 7/20745 454/184
2012/0325570 A1 * 12/2012 Rogers ..... E02F 9/0891 29/525.11
2014/0083774 A1 * 3/2014 Hoult ..... E21B 17/00 175/52
2017/0211340 A1 * 7/2017 Alford ..... E21B 33/068
2019/0186211 A1 * 6/2019 Gonzalez Gonzalez ..... E21B 15/003
2021/0040763 A1 * 2/2021 Hudson ..... E21B 7/023
2022/0061223 A1 * 3/2022 Micka ..... F24F 7/10
2023/0415326 A1 * 12/2023 Monroy Aripez ..... B25F 5/02

FOREIGN PATENT DOCUMENTS

CA 3218302 A1 * 7/2022 ..... E21B 19/087
CA 3015196 C * 7/2023 ..... E21B 15/00
CN 114382428 A * 4/2022 ..... E21B 15/00
SE 1351234 A1 * 4/2015 ..... E21B 15/00
WO WO-2011144734 A1 * 11/2011 ..... B66C 13/52

* cited by examiner

HATCH SYSTEM FOR DRILLING MACHINE

TECHNICAL FIELD

The present disclosure relates to a drilling machine, and more particularly, to a hatch system for the drilling machine.

BACKGROUND

A drilling machine includes multiple components, such as a drill pipe, a drill bit, etc. to perform drilling operations at a worksite. For example, the drilling machine may be used to drill a hole. In order to perform the drilling operation, the drill bit needs to be precisely positioned at a marking location on a work surface.

During the drilling operation, it is required that a placement of the drill bit relative to the work surface is visible to an operator seated within an operator cabin of the drilling machine. For this purpose, a hatch system is associated with the drilling machine. The hatch system includes a grate and a hatch assembly. However, in some drilling machines, such as small-sized drilling machines or transportable drilling machines, a design of conventional grates do not provide a clear view of the drill bit from the operator cabin. If the drill bit is not clearly visible to the operator, it may be challenging for the operator to know an exact position of the drill bit relative to the work surface, which may lead to error in the drilling operation and may impact a productivity of the drilling operation. Further, in some cases, the operator may have to shift their position to view the drill bit, which may be tiresome for the operator and non-ergonomic.

Further, in conventional hatch systems, the hatch assembly is arranged parallel to a deck of the drilling machine. Such an arrangement of the hatch assembly further impacts a view of the drill bit from the operator cabin. Specifically, components of the hatch assembly hinder the view of the drill bit from the operator cabin, which is not desirable. Thus, conventional hatch systems may create a challenge for the operator to clearly view the drill bit and a position of the drill bit relative to the marking location on the work surface while performing the drilling operation.

U.S. Pat. No. 6,095,263 describes a viewport that is located in the floor of a drill rig operator's cab to enable a rig operator to view drilling operations. As drilling commences, the operator may view the material underlying the rig and make a visual determination that the coal seam has been reached, by identifying that the material has the characteristic black color of the coal. When the coal seam is reached, the drilling operation is then altered accordingly to prevent over drilling.

SUMMARY

In an aspect of the present disclosure, a hatch system for a drilling machine is provided. The hatch system includes a viewing grate adapted to be removably coupled with a deck of the drilling machine. The viewing grate includes a frame and a plurality of bars extending along an oblique direction relative to the frame. The plurality of bars are spaced apart from each other. The hatch system also includes a hatch assembly disposed within a dust chamber of the drilling machine. The hatch assembly is disposed at a first oblique angle relative to the deck of the drilling machine. The hatch assembly includes a body. The hatch assembly also includes a door that is movable between an open position and a closed position relative to the body. In the open position of the door, an operator seated within an operator cabin of the drilling machine can view a drill bit of the drilling machine via the viewing grate. In the closed position of the door, the door isolates the deck from the dust chamber. In the closed position of the door, the door is in line with the viewing grate.

In another aspect of the present disclosure, a drilling machine is provided. The drilling machine includes a machine frame defining a dust chamber and a deck. The drilling machine also includes a drill bit that is adapted to be received within the dust chamber. The drilling machine further includes an operator cabin mounted on the machine frame. The drilling machine includes a hatch system removably coupled with the machine frame. The hatch system includes a viewing grate adapted to be removably coupled with the deck of the drilling machine. The viewing grate includes a frame and a plurality of bars extending along an oblique direction relative to the frame. The plurality of bars are spaced apart from each other. The hatch system also includes a hatch assembly disposed within the dust chamber of the drilling machine. The hatch assembly is disposed at a first oblique angle relative to the deck of the drilling machine. The hatch assembly includes a body. The hatch assembly also includes a door that is movable between an open position and a closed position relative to the body. In the open position of the door, an operator seated within an operator cabin of the drilling machine can view the drill bit of the drilling machine via the viewing grate. In the closed position of the door, the door isolates the deck from the dust chamber. In the closed position of the door, the door is in line with the viewing grate.

Other features and aspects of this disclosure will be apparent from the following description and the accompanying drawings.

DETAILED DESCRIPTION

Wherever possible, the same reference numbers will be used throughout the drawings to refer to the same or like parts.

Figure 1:
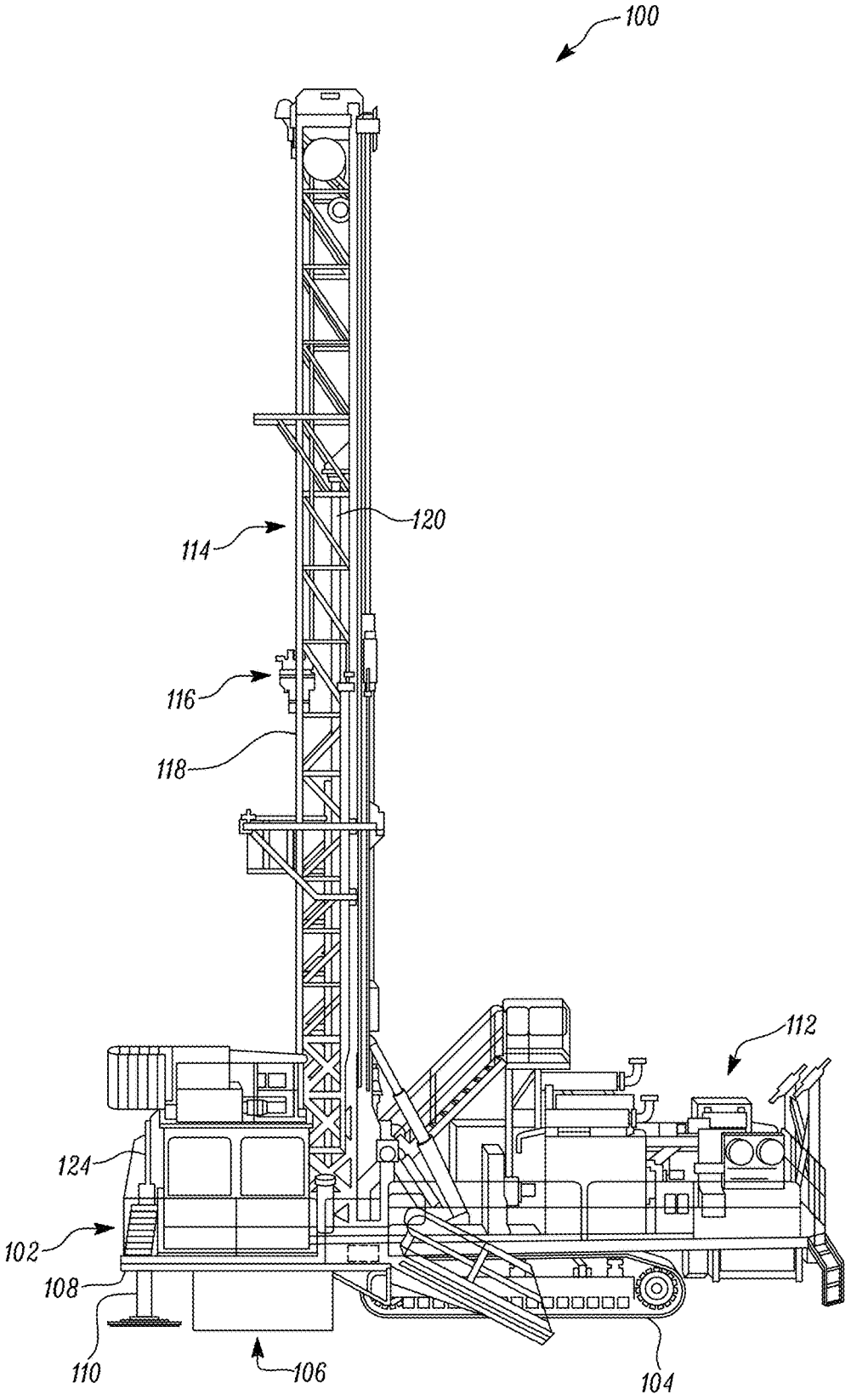
FIG. 1 is a schematic side view of a drilling machine, according to an example of the present disclosure.

Referring to FIG. 1, a schematic perspective view of a drilling machine 100 is illustrated. The drilling machine 100 may be used to perform one or more work operations such as drilling holes, mining blast holes, geothermal wells, and the like. In an example, the drilling machine 100 may be used to drill a hole for a utility installation, soil sampling, a geotechnical investigation, a blasting hole preparation, an anchor installation, and the like. The drilling machine 100 may be a rotary drilling machine or a down-the-hole drilling machine. In the illustrated example of FIG. 1, the drilling machine 100 is embodied as the rotary drilling machine.

The drilling machine 100 includes a machine frame 102. The machine frame 102 may be supported on a ground surface by a transport mechanism, such as crawler tracks 104. The crawler tracks 104 may allow the drilling machine 100 to maneuver on the ground surface to a desired location to perform one or more work operations. Alternatively, the drilling machine 100 may include wheels instead of the crawler tracks 104.

The machine frame 102 defines a dust chamber 106. The dust chamber 106 may capture the dust that is generated during the drilling operation. The dust chamber 106 is enclosed by dust curtains to contain dust generated during drilling operations. The machine frame 102 also defines a deck 108. Specifically, the dust chamber 106 is defined beneath the deck 108 of the machine frame 102. The drilling machine 100 also includes one or more jacks 110 for supporting and leveling the drilling machine 100 on the ground surface.

The drilling machine 100 further includes a machinery 112. The machine frame 102 may support the machinery 112, which may include various components (not shown herein), such as a power source (for example, an internal combustion engine, a battery system, or fuel cells), motors, pumps, air compressors, and/or any other equipment necessary to supply power to operate the drilling machine 100.

The drilling machine 100 includes a mast assembly 114. The mast assembly 114 may be supported by the machine frame 102 of the drilling machine 100. The drilling machine 100 also includes a drill head 116 movable relative to the mast assembly 114. The drill head 116 may be supported on a mast frame 118. The machinery 112 may provide power to operate the drill head 116 relative to the mast assembly 114. The drilling machine 100 further includes a drill pipe 120 coupled to the drill head 116 to perform drilling operations.

The drilling machine 100 includes a drill bit 122 (shown in FIG. 2) received within the dust chamber 106. Specifically, the drill bit 122 is received within the dust chamber 106 when a drilling operation is being performed. Alternatively, the drilling machine 100 may include a hammer coupled to the drill head 116 instead of the drill bit 122, as per application requirements.

While performing the drilling operation, the drill bit 122 may contact the ground surface resulting in generation of dust. The drill bit 122 is coupled with the drill pipe 120 to perform the drilling operations. The drilling machine 100 also includes an operator cabin 124 mounted on the machine frame 102. An operator is seated in the operator cabin 124 to maneuver and control the drilling machine 100 and the drilling operation. The operator cabin 124 includes one or more controls that allow the operator to perform one or more work operations.

Figure 2:
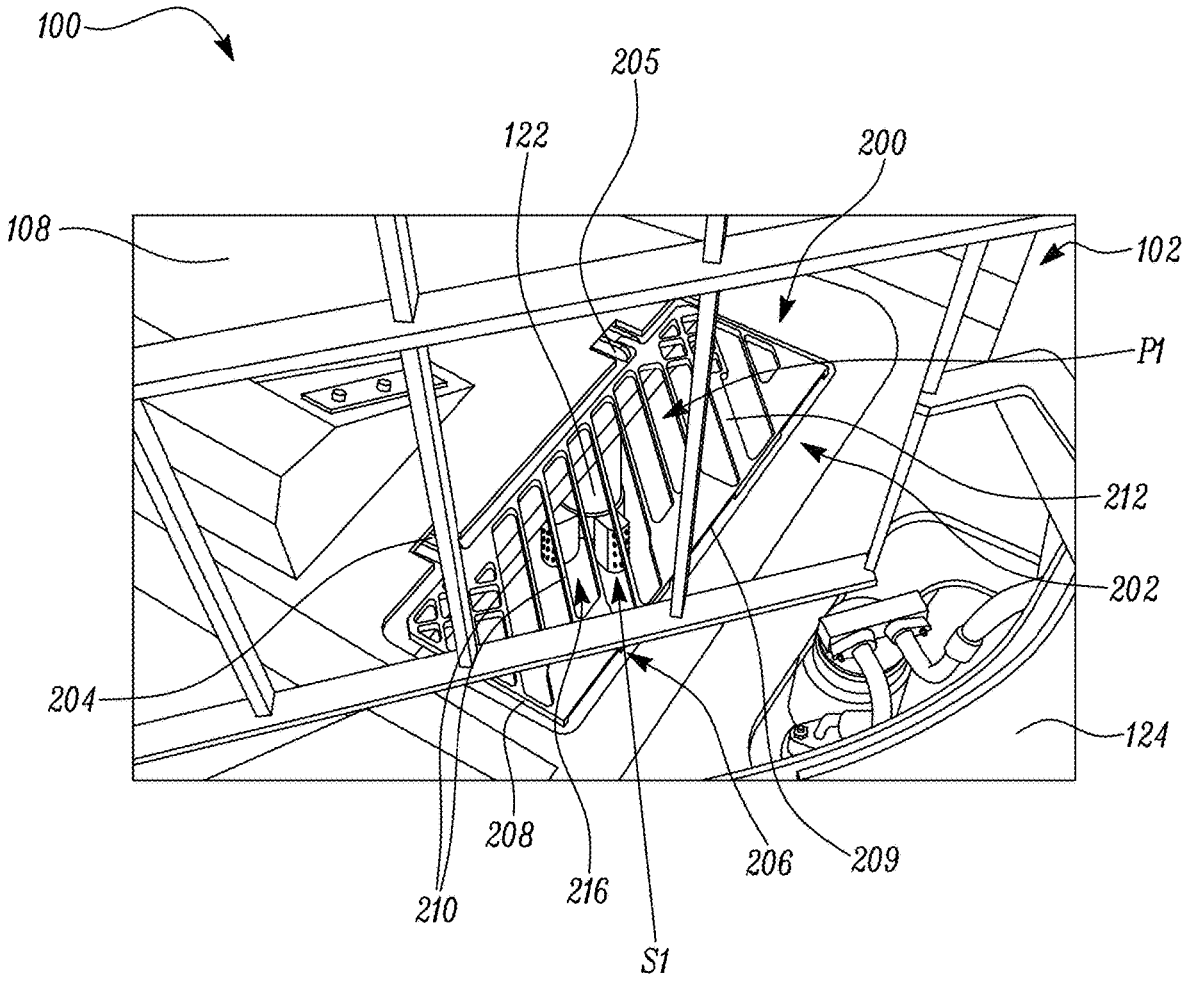
FIGS. 2 and 3 are schematic perspective views of a portion of the drilling machine of FIG. 1 illustrating a hatch system, according to an example of the present disclosure.
Figure 3:
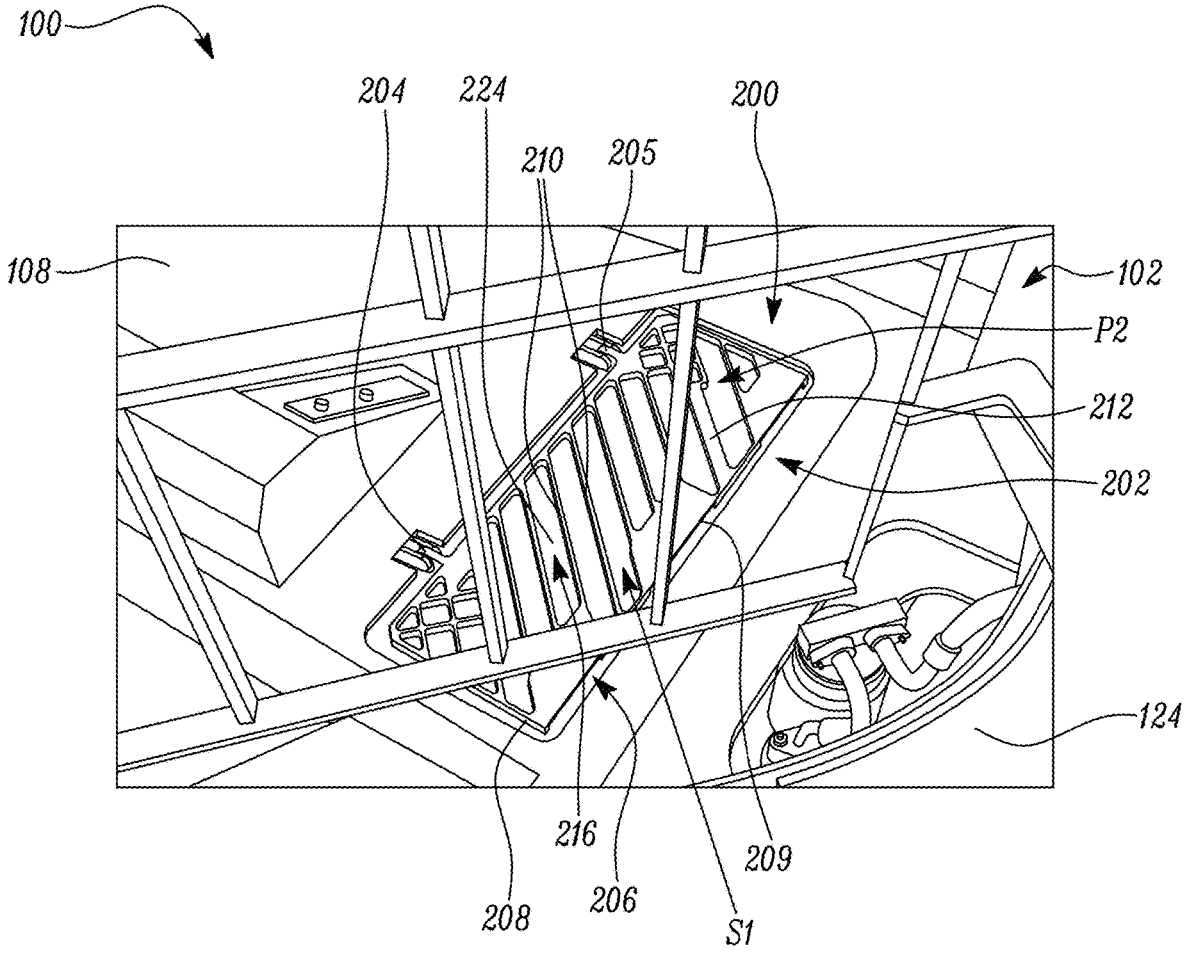

FIGS. 2 and 3 are schematic perspective views of a portion of the drilling machine 100 illustrating a hatch system 200. Specifically, the drilling machine 100 includes the hatch system 200 removably coupled with the machine frame 102. The hatch system 200 includes a viewing grate 202 removably coupled with the deck 108 of the drilling machine 100. The viewing grate 202 of the hatch system 200 may be made of a metal, a polymer, a ceramic material, an alloy, and the like, without limiting the scope of the present disclosure. The operator seated within the operator cabin 124 of the drilling machine 100 can view the drill bit 122 of the drilling machine 100 via the viewing grate 202. FIG. 2 shows a view of the drill bit 122 from the operator cabin 124. As visible from FIG. 2, the drill bit 122 lies in a line of sight S1 from the operator cabin 124. FIG. 3 also shows a view of the deck 108 as visible from the operator cabin 124.

Figure 4:
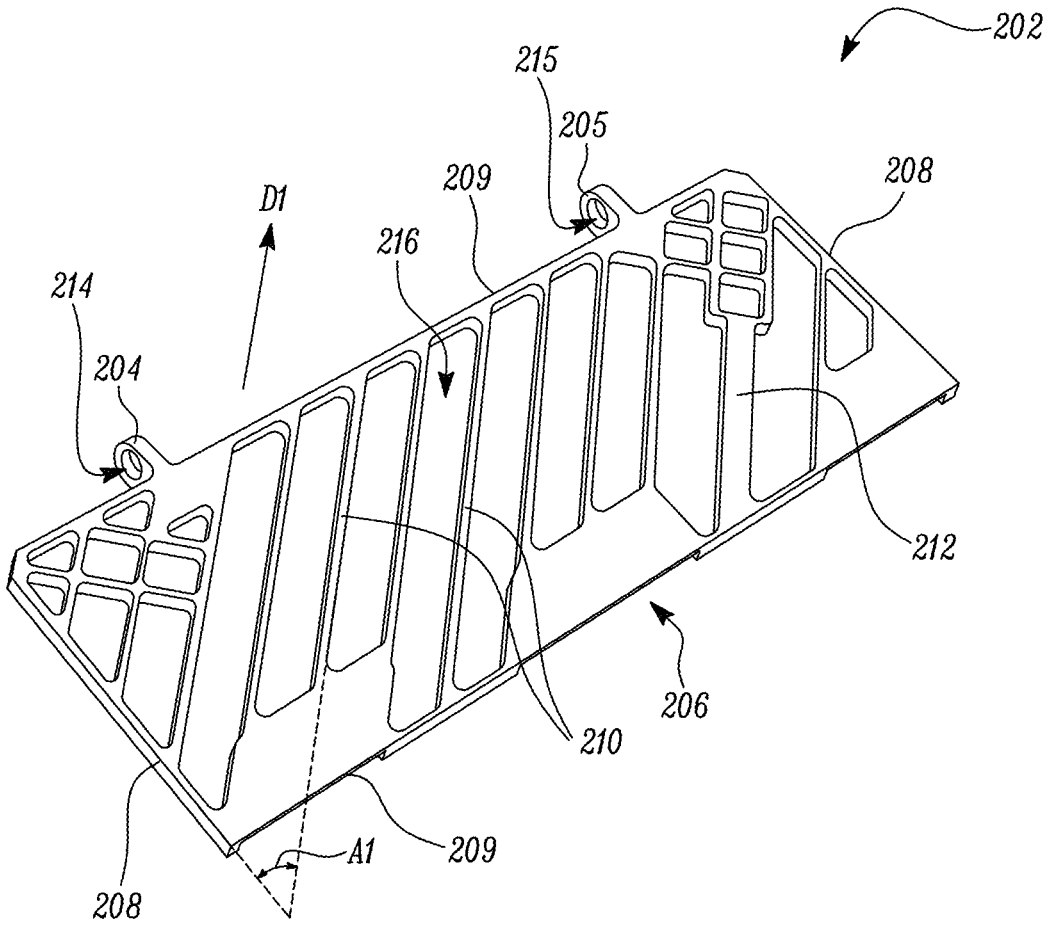
FIG. 4 is a schematic perspective view of a viewing grate of the hatch system of FIG. 2.

Referring to FIG. 4, a schematic perspective view of the viewing grate 202 is illustrated. The viewing grate 202 includes a frame 206. In the illustrated example of FIG. 4, the frame 206 of the viewing grate 202 is rectangular in shape. In other examples, the viewing grate 202 may have a square shape, a circular shape, or any other shape that allows clear visibility of the drill bit 122 (see FIG. 2), without limiting the scope of the present disclosure.

The frame 206 of the viewing grate 202 includes a number of side members 208, 209. Specifically, the frame 206 includes two side members 208 and two side members 209 that together define the rectangular shape of the frame 206. The viewing grate 202 also includes a number of bars 210 extending along an oblique direction D1 relative to the frame 206. The number of bars 210 are spaced apart from each other. The number of bars 210 are disposed parallel to each other. Each of the number of bars 210 of the viewing grate 202 is disposed at an angle A1 relative to each of the number of side members 208, 209 of the frame 206. The angle A1 between each of the number of bars 210 and a corresponding side member 208, 209 from the number of side members 208 is decided such that the drill bit 122 lies in the line of sight S1 (see FIG. 2) of the operator seated within the operator cabin 124 (see FIGS. 1 to 3). Specifically, each bar 210 is spaced apart from an adjacent bar 210 to define a slot 216 through which the operator seated within the operator cabin 124 can view the drill bit 122.

The viewing grate 202 further includes a pair of fastening elements 204, 205. The pair of fastening elements 204, 205 pivotably couple the viewing grate 202 with the deck 108 (see FIG. 2). The pair of fastening elements 204, 205 extends from the frame 206 of the viewing grate 202. Specifically, the pair of fastening elements 204, 205 includes a fastening element 204 and a fastening element 205. The pair of fastening elements 204, 205 are coupled to the side member 209 of the frame 206. In an example, the fastening elements 204, 205 may be welded to the frame 206. Alternatively, the fastening elements 204, 205 may be integral with the frame 206. It should be noted that the fastening element 204 and the fastening element 205 are substantially similar to each other. Each of the pair of fastening elements 204, 205 defines a corresponding through-opening 214, 215. Particularly, the fastening element 204 defines the through-opening 214 and the fastening element 205 defines the through-opening 215. The through-openings 214, 215 may receive fasteners (not shown) to removably couple the viewing grate 202 with the deck 108 (see FIG. 2).

The viewing grate 202 further includes a handle 212 that is integral with the frame 206 of the viewing grate 202. In some examples, the handle 212 of the viewing grate 202 may be a separate part. In some examples, the handle 212 may be welded or fastened using fasteners with the frame 206 of the viewing grate 202. The handle 212 may have any shape, based on application attributes. Further, the handle 212 may be made of a material similar to the material of the frame 206. The handle 212 can be held by an operator or a personnel to pivot and move the viewing grate 202 to an open position.

Figure 5:
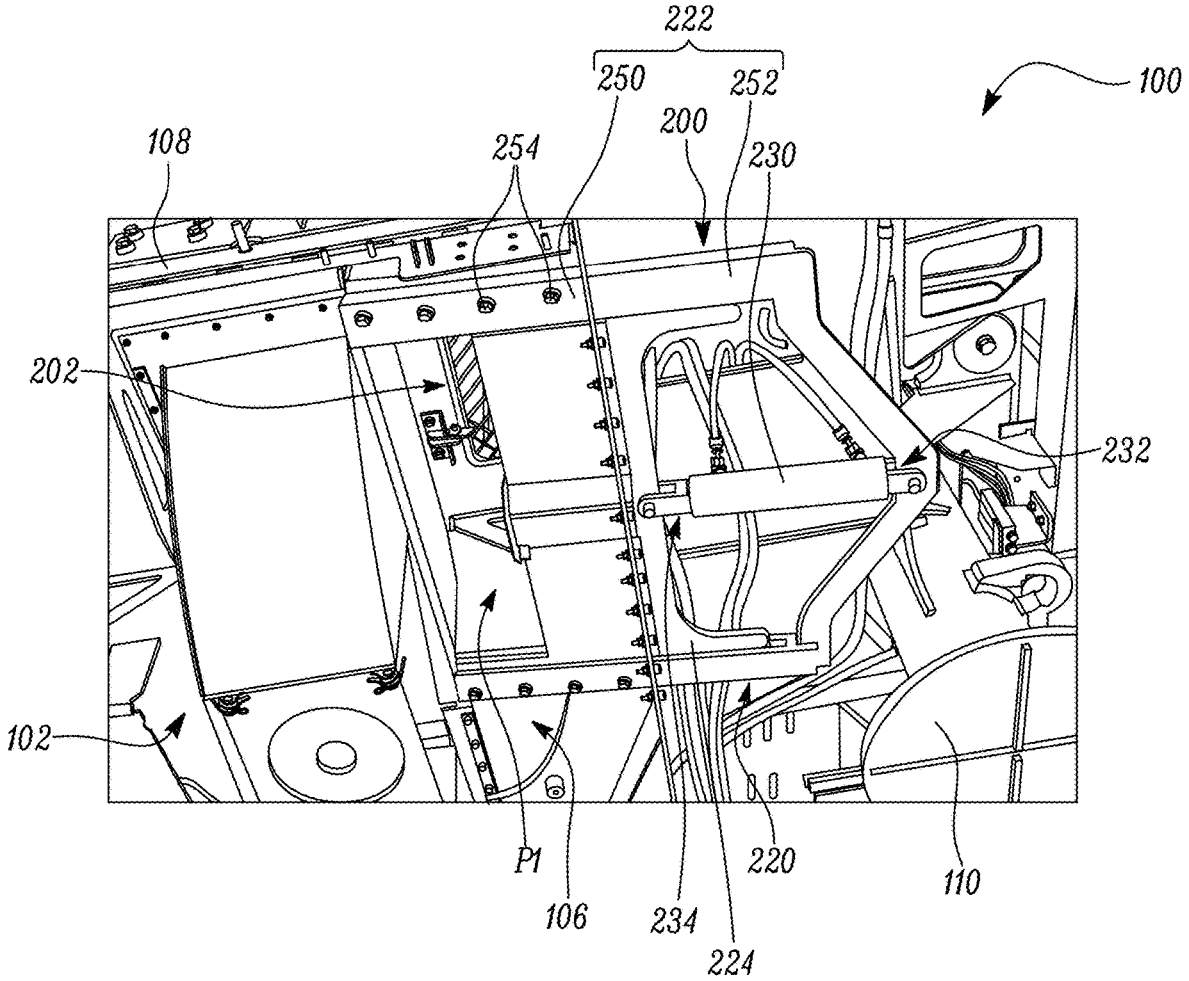
FIG. 5 is a schematic bottom perspective view of the hatch system of FIGS. 2 and 3 illustrating the viewing grate and a hatch assembly, according to an example of the present disclosure.

Referring to FIG. 5, a schematic bottom perspective view of the hatch system 200 illustrating the viewing grate 202 and a hatch assembly 220 is shown. Specifically, the hatch system 200 includes the hatch assembly 220 disposed within the dust chamber 106 of the drilling machine 100. The hatch assembly 220 is disposed at a first oblique angle A2 (shown in FIG. 7) relative to the deck 108 of the drilling machine 100.

The hatch assembly 220 includes a body 222. The hatch assembly 220 also includes a door 224 that is movable between an open position P1 and a closed position P2 (shown in FIG. 3) relative to the body 222. In some examples, each of the body 222 and the door 224 may be made of a metal, a polymer, a ceramic material, an alloy, and the like, without limiting the scope of the present disclosure.

The door 224 is shown in the open position P1 in FIGS. 2 and 5. In the opened position P1, the operator seated within the operator cabin 124 (see FIG. 2) of the drilling machine 100 may view the drill bit 122 (see FIG. 2) of the drilling machine 100 via the viewing grate 202.

In the closed position P2 of the door 224, the door 224 isolates the deck 108 from the dust chamber 106. The door 224 is shown in the closed position P2 in FIG. 3. Further, in the closed position P2 of the door 224, the door 224 is in line with the viewing grate 202.

Figure 6:
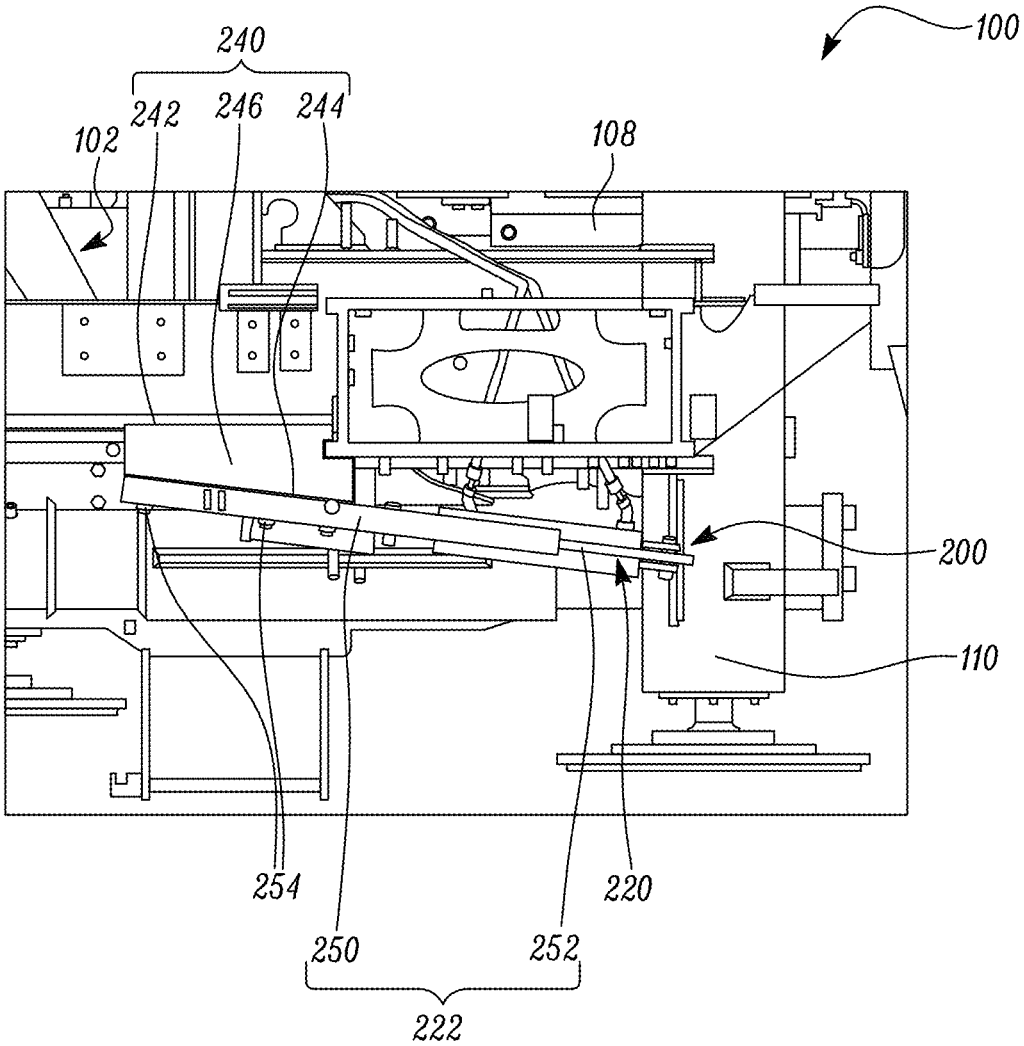
FIG. 6 is a schematic side view of the hatch assembly of FIG. 5.
Figure 7:
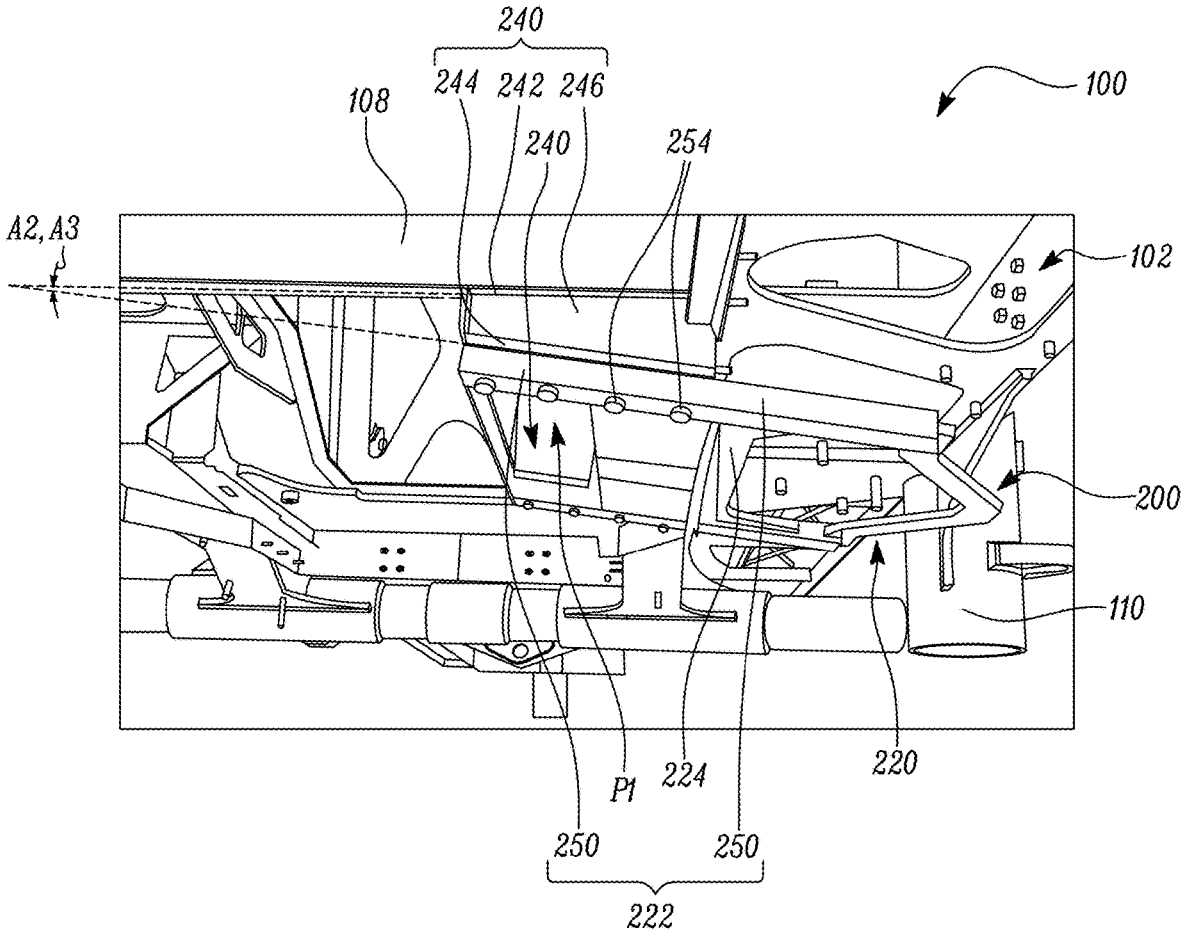
FIG. 7 is a schematic bottom perspective view of the hatch assembly of FIG. 5.

With reference to FIGS. 6 and 7, the hatch system 200 further includes a pair of connecting brackets 240 to couple the hatch assembly 220 to the machine frame 102 of the drilling machine 100. Each of the pair of connecting brackets 240 includes a first wall 242 that is coupled with the machine frame 102. The first wall 242 is substantially parallel to the machine frame 102. In an example, the first wall 242 of the connecting brackets 240 may be removably coupled to the machine frame 102 via mechanical fasteners, such as bolts, screws, pins, and the like, without limiting the scope of the present disclosure. Alternatively, the first wall 242 of the connecting brackets 240 may be fixedly coupled to the machine frame 102 by welding, soldering, brazing, or any other joining technique known in the art.

Each of the pair of connecting brackets 240 also includes a second wall 244 that is removably coupled with the body 222 of the hatch assembly 220. The second wall 244 is disposed at a second oblique angle A3 relative to the first wall 242. The second oblique angle A3 is same as the first oblique angle A2. Each of the pair of connecting brackets 240 further includes an intermediate wall 246 extending between the first wall 242 and the second wall 244. The pair of connecting brackets 240 dispose the hatch assembly 220 at the first oblique angle A2 relative to the deck 108.

Referring again to FIG. 5, the body 222 of the hatch assembly 220 includes a first body portion 250 that is removably coupled with each of the pair of connecting brackets 240. The hatch assembly 220 also includes a number of fasteners 254 to removably couple the first body portion 250 with each of the pair of connecting brackets 240. In some examples, the number of fasteners 254 may include bolts, screws, pins, and the like.

The body 222 of the hatch assembly 220 further includes a second body portion 252 extending laterally from the first body portion 250. The hatch assembly 220 includes an actuator 230 to move the door 224 between the open position P1 and the closed position P2 (see FIG. 3). In some examples, the actuator 230 may be a pneumatic actuator, a hydraulic actuator, a hydraulic motor, an electric actuator, and the like, without limiting the scope of the present disclosure. A first end 232 of the actuator 230 is coupled with the second body portion 252. A second end 234 of the actuator 230 is coupled with the door 224 of the hatch assembly 220.

In an example, before performing a drilling operation, the operator may actuate the actuator 230 to move the door 224 to the open position P1, which may allow the operator to view an exact position of the drill bit 122 (see FIG. 2) through the viewing grate 202 to precisely position the drill bit 122 at a correct marking location on a work surface. Further, after positioning the drill bit 122 at the correct marking location on the work surface, the operator may actuate the actuator 230 to move the door 224 to the closed position P2. The door 224 may be retained in the closed position P2 to prevent entry of dust/dirt towards the deck 108 and the operator cabin 124, while the drilling operation is being performed. Further, in some examples, the door 224 may be retained in the open position P1 to collect dust samples and identify a change of dust color during the drilling operation to determine if the drill bit 122 has hit a coal seam.

It is to be understood that individual features shown or described for one embodiment may be combined with individual features shown or described for another embodiment. The above-described implementation does not in any way limit the scope of the present disclosure. Therefore, it is to be understood although some features are shown or described to illustrate the use of the present disclosure in the context of functional segments, such features may be omitted from the scope of the present disclosure without departing from the spirit of the present disclosure as defined in the appended claims.

INDUSTRIAL APPLICABILITY

The present disclosure relates to the hatch system 200 of the drilling machine 100. The hatch system 200 includes the viewing grate 202 that is removably coupled with the deck 108 of the drilling machine 100. The viewing grate 202 includes the side members 208, 209 and the number of bars 210 spaced apart from each other. Each of the number of bars 210 of the viewing grate 202 is disposed at the angle A1 relative to each of the number of side members 208, 209 of the frame 206. The bars 210 disposed at the angle A1 may increase a visibility of the drill bit 122 for the operator seated within the operator cabin 124. In other words, the hatch system 200 may allow the operator seated on a seat within the operator cabin 124 of the drilling machine 100 to view the drill bit 122, to view a position of the drill bit 122 relative to the correct marking location on the work surface, and to view the marking location on the work surface. The hatch system 200 may reduce operator fatigue as the operator may not have to adjust their position frequently to view the drill bit 122 and/or the marking location.

The hatch system 200 also includes the hatch assembly 220 disposed at the first oblique angle A2 relative to the deck 108 of the drilling machine 100. The hatch assembly 220 disposed at the first oblique angle A2 may further increase the visibility of the drill bit 122 for the operator seated within the operator cabin 124, as compared to conventional hatch systems. In other words, as the hatch assembly 220 is disposed at the first oblique angle A2, components of the hatch assembly do not obstruct the view of the drill bit 122 from the operator cabin 124. The viewing grate 202 and the hatch assembly 220 may allow the operator to collect dust samples and may allow the operator to identify the change in color of the dust during drilling operations to determine if the drill bit 122 has reached the coal seam.

Further, a design and a coupling technique of the viewing grate 202 and the hatch assembly 220 may allow a positioning of the hatch system 200 within a vicinity of the deck 108 and the operator cabin 124 that is otherwise surrounded by multiple components and has a compact and complex geometry.

The hatch assembly 220 is removably coupled with the connecting brackets 240 via fasteners 254. This may provide flexibility for the operator to remove/replace the hatch assembly 220. Further, in some examples, the operator may use the hatch assembly 220 as an optional attachment. Further, the connecting brackets 240 may have a modular design that may vary based on a type of the drilling machine, thereby allowing usage of the hatch assembly 220 on different drilling machines.

Overall, the hatch system 200 may improve visibility of the drill bit 122 and the marking location, may be simple in construction, may be cost-effective, may be reliable, and may be durable. The hatch system 200 may be easy to manufacture as the hatch system 200 does not require costly/complicated set-ups for manufacturing. Further, the hatch system 200 may be retrofitted on existing drilling machines. Moreover, the hatch system 200 may be used on a variety of drilling machines.

While aspects of the present disclosure have been particularly shown and described with reference to the embodiments above, it will be understood by those skilled in the art that various additional embodiments may be contemplated by the modification of the disclosed work machine, systems and methods without departing from the spirit and scope of the disclosure. Such embodiments should be understood to fall within the scope of the present disclosure as determined based upon the claims and any equivalents thereof.

The invention claimed is:

1. A hatch system for a drilling machine, the hatch system comprising:

a viewing grate adapted to be removably coupled with a deck of the drilling machine, wherein the viewing grate includes a frame and a plurality of bars extending along an oblique direction relative to the frame, and wherein the plurality of bars are spaced apart from each other; and a hatch assembly disposed below the viewing grate and within a dust chamber of the drilling machine, wherein the hatch assembly is inclined at a first angle relative to the deck of the drilling machine, and wherein the hatch assembly includes:

a body;

a door that is movable between a lower, open position and a raised, closed position relative to the body, wherein, in the open position of the door, an operator seated within an operator cabin of the drilling machine above the deck of the drilling machine can view a drill bit of the drilling machine below the deck and in the dust chamber of the drilling machine via the viewing grate, wherein, in the raised, closed position of the door, the door isolates the deck from the dust chamber below the deck, and wherein, in the raised, closed position of the door, the door is in line with the viewing grate; and a pair of connecting brackets adapted to couple the hatch assembly to a machine frame of the drilling machine, wherein each of the pair of connecting brackets includes:

a first wall that is adapted to be coupled with the machine frame;

a second wall that is adapted to be removably coupled with the body of the hatch assembly, wherein the second wall is disposed at a second angle relative to the first wall, and wherein the second angle is same as the first angle; and an intermediate wall extending between the first wall and the second wall.

2. The hatch system of claim 1, wherein the frame of the viewing grate includes a plurality of side members, and wherein each of the plurality of bars of the viewing grate is disposed at an angle relative to each of the plurality of side members of the frame.

3. The hatch system of claim 2, wherein each of the plurality of bars is oriented at an angle relative to a corresponding side member of the plurality of side members such that the drill bit lies in a line of sight of the operator seated within the operator cabin.

4. The hatch system of claim 1, wherein the viewing grate includes a handle that is integral with the frame of the viewing grate.

5. The hatch system of claim 1, wherein the viewing grate includes a pair of fastening elements adapted to pivotably couple the viewing grate with the deck.

6. The hatch system of claim 1, wherein the frame of the viewing grate is rectangular in shape.

7. The hatch system of claim 1, wherein the body of the hatch assembly includes:

a first body portion that is removably coupled with each of the pair of connecting brackets, and a second body portion extending laterally from the first body portion.

8. The hatch system of claim 7, wherein the hatch assembly includes a plurality of fasteners adapted to removably couple the first body portion with each of the pair of connecting brackets.

9. The hatch system of claim 7, wherein the hatch assembly includes an actuator adapted to move the door between the lower, open position and the raised, closed position, wherein a first end of the actuator is coupled with the second body portion, and wherein a second end of the actuator is coupled with the door of the hatch assembly.

10. A drilling machine comprising:

a machine frame defining a dust chamber and a deck;

a drill bit that is adapted to be received within the dust chamber;

an operator cabin mounted on the machine frame; and a hatch system removably coupled with the machine frame, wherein the hatch system includes:

a viewing grate adapted to be removably coupled with the deck of the drilling machine, wherein the viewing grate includes a frame and a plurality of bars extending along an oblique direction relative to the frame, and wherein the plurality of bars are spaced apart from each other;

a hatch assembly disposed below the viewing grate and within the dust chamber of the drilling machine, wherein the hatch assembly is inclined at a first angle relative to the deck of the drilling machine, and wherein the hatch assembly includes:

a body; and a door that is movable between a lower, open position and a raised, closed position relative to the body, wherein, in the lower, open position of the door, an operator seated within the operator cabin of the drilling machine above the deck of the drilling machine can view the drill bit of the drilling machine via the viewing grate, wherein, in the raised, closed position of the door, the door isolates the deck from the dust chamber below the deck, and wherein, in the raised, closed position of the door, the door is in line with the viewing grate; and a pair of connecting brackets adapted to couple the hatch assembly to the machine frame of the drilling machine, wherein each of the pair of connecting brackets includes:

a first wall that is adapted to be coupled with the machine frame;

a second wall that is adapted to be removably coupled with the body of the hatch assembly, wherein the second wall is disposed at a second angle relative to the first wall, and wherein the second angle is same as the first angle; and an intermediate wall extending between the first wall and the second wall.

11. The drilling machine of claim 10, wherein the frame of the viewing grate includes a plurality of side members, and wherein each of the plurality of bars of the viewing grate is disposed at an angle relative to each of the plurality of side members of the frame.

12. The drilling machine of claim 11, wherein each of the plurality of bars is oriented at an angle relative to a corresponding side member of the plurality of side members such that the drill bit lies in a line of sight of the operator seated within the operator cabin.

13. The drilling machine of claim 10, wherein the viewing grate includes a handle that is integral with the frame of the viewing grate.

14. The drilling machine of claim 10, wherein the viewing grate includes a pair of fastening elements adapted to pivotably couple the viewing grate with the deck.

15. The drilling machine of claim 10, wherein the frame of the viewing grate is rectangular in shape.

16. The drilling machine of claim 10, wherein the body of the hatch assembly includes:

a first body portion that is removably coupled with each of the pair of connecting brackets, and a second body portion extending laterally from the first body portion.

17. The drilling machine of claim 16, wherein the hatch assembly includes a plurality of fasteners adapted to removably couple the first body portion with each of the pair of connecting brackets.

18. The drilling machine of claim 16, wherein the hatch assembly includes an actuator adapted to move the door between the lower, open position and the raised, closed position, wherein a first end of the actuator is coupled with the second body portion, and wherein a second end of the actuator is coupled with the door of the hatch assembly.

* * * * *